US006213555B1

(12) United States Patent
Sulpizio et al.

(10) Patent No.: US 6,213,555 B1
(45) Date of Patent: Apr. 10, 2001

(54) ADJUSTABLE ANGLE CHAISE LOUNGE CONSTRUCTION

(76) Inventors: Dennis D. Sulpizio; Teresa A. Sulpizio, both of 1206-112 Clements Bridge Rd., Barrington, NJ (US) 08007

( * ) Notice: Subject to any disclaimer, the term of this patent is extended or adjusted under 35 U.S.C. 154(b) by 0 days.

(21) Appl. No.: 09/621,298

(22) Filed: Jul. 20, 2000

(51) Int. Cl.[7] ..... B60N 2/02

(52) U.S. Cl. ..... 297/377; 297/31; 108/116

(58) Field of Search ..... 297/900, 16.1, 297/19, 21, 29, 31, 51, 377, 408, 423.27, 423.31, 423.32, 440.23, 440.15, 440.22, 440.24, 452.2, 452.63; 5/111, 110, 114, 656, 657; 108/116, 118, 157.1

(56) References Cited

U.S. PATENT DOCUMENTS

| | | | | |
|---|---|---|---|---|
| 2,994,093 | | 8/1961 | Wagner | 5/75 |
| 3,365,072 | * | 1/1968 | Hill | 108/116 X |
| 3,491,705 | * | 1/1970 | Blanke | 108/116 X |
| 3,495,873 | * | 2/1970 | Hamilton, II et al. | 108/116 X |
| 3,897,102 | | 7/1975 | Lemaire | 297/191 |
| 4,264,102 | * | 4/1981 | Sroub | 297/377 |
| 4,470,630 | | 9/1984 | Shields | 297/118 |
| 4,686,910 | * | 8/1987 | Skjerseth | 108/118 |
| 5,246,265 | * | 9/1993 | Nagan et al. | 297/31 X |
| 5,926,871 | | 7/1999 | Howard | 5/111 |
| 5,950,259 | | 9/1999 | Boggs | 5/111 |

* cited by examiner

*Primary Examiner*—Laurie K. Cranmer
(74) *Attorney, Agent, or Firm*—Henderson & Sturm LLP

(57) ABSTRACT

An angularly adjustable lounge chair construction (10) including: a lounge chair unit (11) comprising an articulated tubular framework member (20) having a headrest segment (21), an upper torso segment (22), a lower torso segment (23), and a footrest segment (24) pivotally connected to one another by a plurality of adjustable pivot arrangements (30) and a pair of adjustable support units (12) each including a pair of adjustable length support leg members (40) (40') pivotally connected to one another and adapted to be releasably engaged by a plurality of clamp elements (29) disposed on the underside of the articulated framework member for maintaining the segments (21) through (24) of the articulated tubular framework member (20) at different angular orientations and heights relative to one another.

12 Claims, 2 Drawing Sheets

ADJUSTABLE ANGLE CHAISE LOUNGE CONSTRUCTION

BACKGROUND OF THE INVENTION

1. Field of the Invention

The present invention relates to the field of lounge chair constructions in general, and in particular to a unique angularly adjustable chaise lounge construction.

2. Description of Related Art

As can be seen by reference to the following U.S. Pat. Nos. 2,994,093; 3,897,102; 4,470,630; 5,926,871; and 5,950,259, the prior art is replete with myriad and diverse lounge chair constructions.

While all of the aforementioned prior art constructions are more than adequate for the basic purpose and function for which they have been specifically designed, they are uniformly deficient with respect to their failure to provide a simple, efficient, and practical pivoted leg assembly that can support the main lounge support panels at a variety of different angular orientations relative to one another, as well as the horizontal plane.

While all of the prior art devices include at least one horizontally disposed support panel that coincides with the user's mid torso, there are many instances wherein it would be desirable to dispose the seat portion of the lounge chair at an angle other than the horizontal plane.

As a consequence of the foregoing situation, there has existed a longstanding need for a new and improved type of adjustable angle chaise lounge construction that employs a unique leg support arrangement that permits the three main lounge panels to be disposed at a variety of angles relative to one another, and the provision of such a construction is a stated objective of the present invention.

BRIEF SUMMARY OF THE INVENTION

Briefly stated, the adjustable angle lounge chair construction that forms the basis of the present invention comprises in general, a lounge chair unit and a pair of adjustable length support units that are adapted to selectively engage and support different portions of the lounge chair unit at different heights and angular orientations.

As will be explained in greater detail further on in the specification, the lounge chair unit comprises an articulated tubular framework member which includes a head rest segment, an upper torso segment, a lower torso segment, and a foot rest segment which are connected to one another by a plurality of adjustable pivot arrangements that are adapted to dispose the segments of the articulated tubular framework member at different angular orientations relative to one another.

In addition, each one of the pair of support units includes a pair of generally rectangular adjustable length support leg members pivotally connected to one another wherein each of the adjustable length support leg members has a generally U-shaped lower leg portion that telescopically receives a generally U-shaped upper leg portion which is adapted to be releasably engaged in selected clamp elements disposed on the underside of each of the segments of the articulated tubular framework member for maintaining the segments at desired heights relative to one another.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
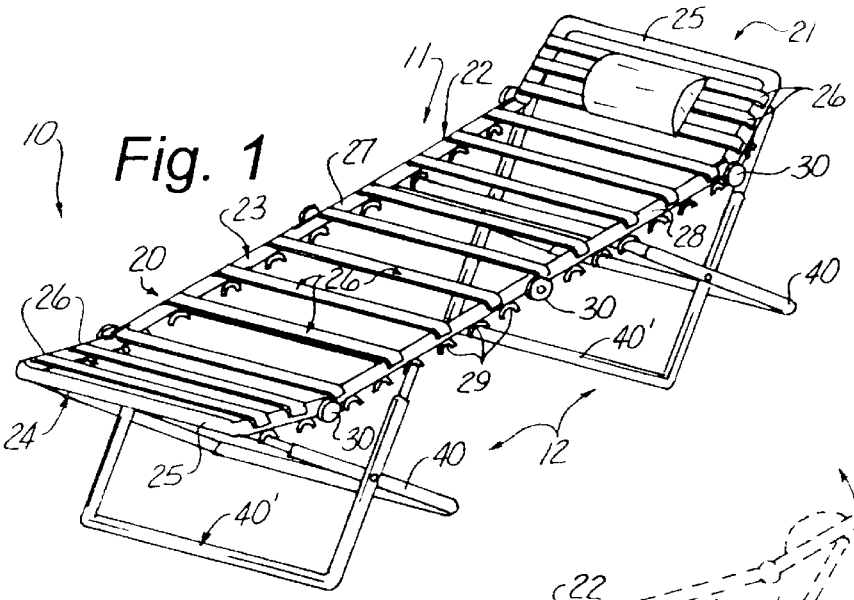
FIG. 1 is a perspective view of the angularly adjustable lounge chair construction that forms the basis of the present invention.

As can be seen by reference to the drawings, and in particular to FIG. 1, the angularly adjustable lounge chair construction that forms the basis of the present invention is designated generally by the reference number 10. The construction 10 comprises in general, an articulated lounge chair unit 11, and a pair of adjustable support units 12. These units will now be described in seriatim fashion.

Figure 2:
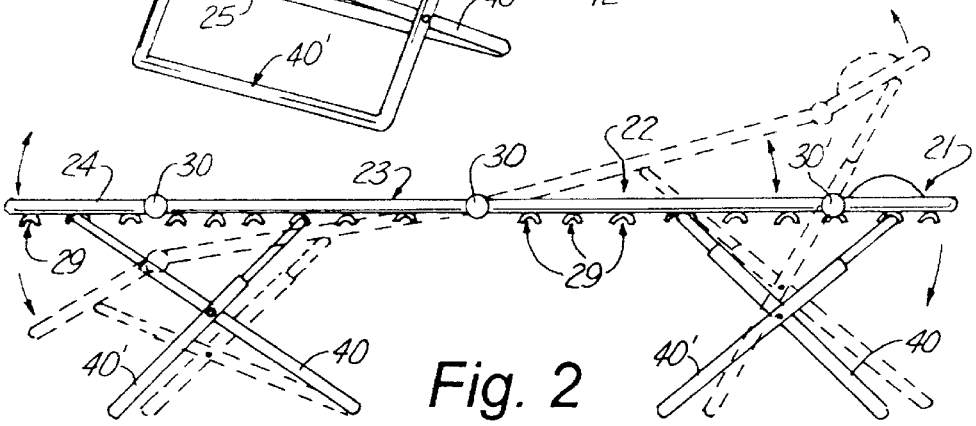
FIG. 2 is a side elevation view of the lounge chair construction.
Figure 6:
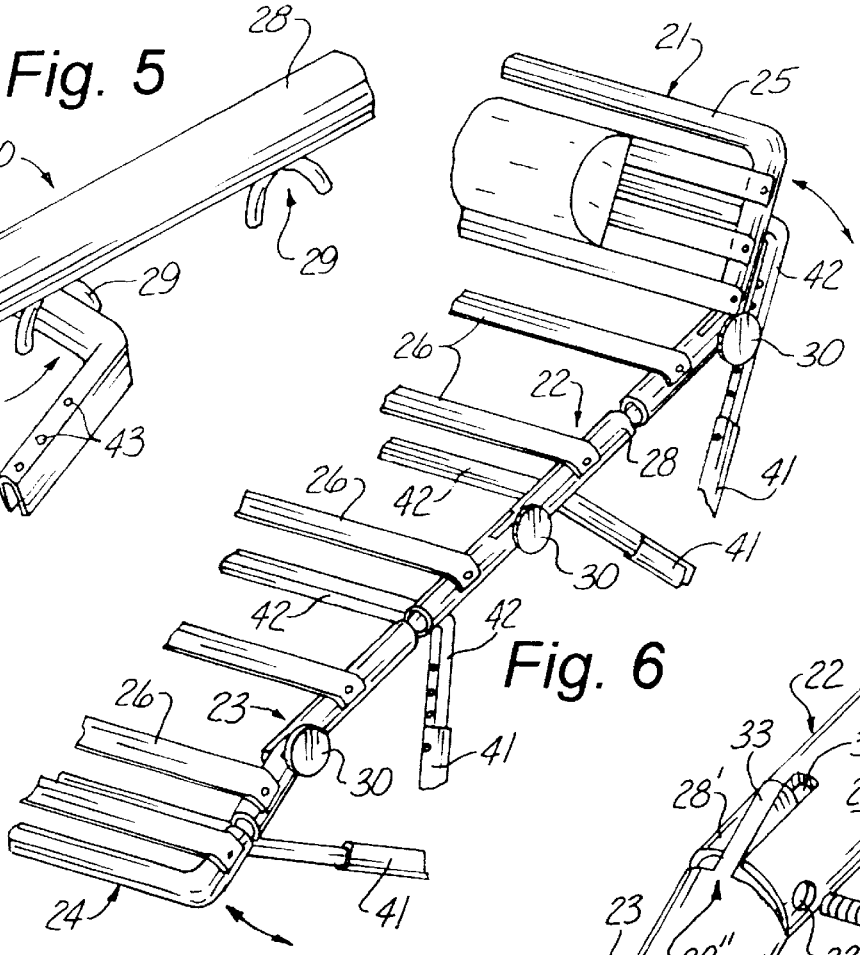
FIG. 6 is a perspective view of one side of the lounge chair construction.

As shown in FIGS. 1, 2, and 6, the lounge chair unit 11 comprises an articulated generally rectangular tubular framework member 20 which includes a generally U-shaped head rest segment 21, an upper torso segment 22, a lower torso segment 23, and a generally U-shaped foot rest segment 24 which are pivotally connected to one another in a sequential fashion by a pivot arrangement designated generally as 30.

As can best be seen by reference to FIG. 1, both the head rest segment 21, and the foot rest segment 24 comprise a U-shaped tubular section 25 whose opposite sides are connected to one another by a plurality of plastic strap elements 26. Each of the upper and lower torso segments 22, 23 comprise a pair of widely spaced tubular sections 27, 28 which are also provided with strap elements 26.

Figure 7:
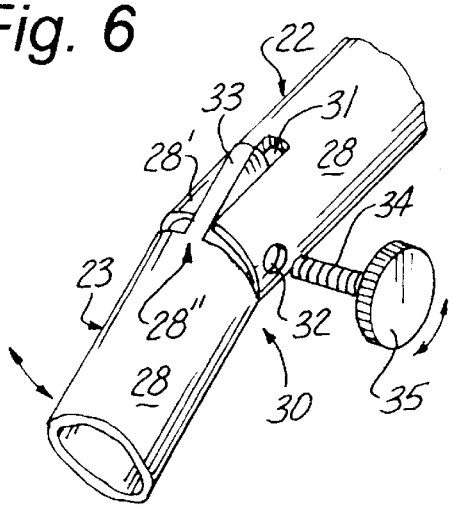
FIG. 7 is an isolated detail view of the tubular framework adjustment member.

As shown in FIG. 7, each of the pair of tubular sections 27, 28 are connected to one another by a pivot adjustment arrangement 30. Each tubular section 28 has a slot 31 and a transverse threaded aperture 32 formed on one end 28' and an apertured flange 33 formed on the other end 28". The slot 31 is dimensioned to receive the apertured flange 33 and the apertured flange 33 and the transverse threaded apertures 32 are dimensioned to receive the threaded stem 34 of an angular pivot adjustment knob 35.

Turning now to FIGS. 1, 2, 5, and 8, it can be seen that the underside of each of the segments 21, 22, 23, and 24 of the articulated framework member 20 are provided with a plurality of spaced clamp elements 29 whose purpose and function will be explained in greater detail further on in the specification.

Figure 4:
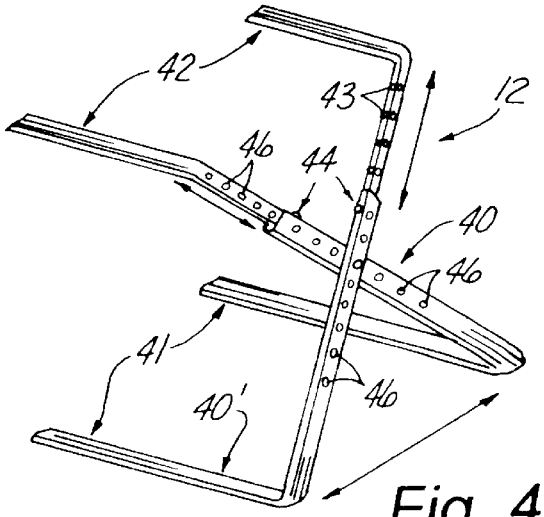
FIG. 4 is a perspective view of one side of one of the leg assemblies.

As shown in FIGS. 1, 2, and 4, each of the pair of adjustable support units 12 comprise a pair of generally rectangular adjustable length support leg members 40, 40' which are pivotally connected to one another. Each of the support leg members 40, 40' include a hollow U-shaped lower leg portion 41 which is dimensioned to telescopically receive a smaller diameter U-shaped upper leg portion 42.

Figure 5:
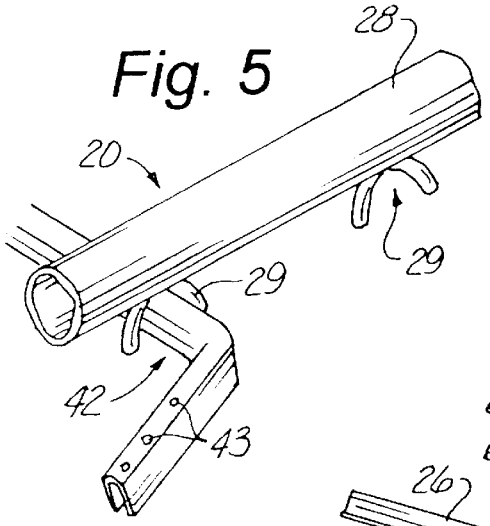
FIG. 5 is an isolated detail view of the operative engagement between the upper end of a leg assembly and one of the tubular framework.
Figure 8:
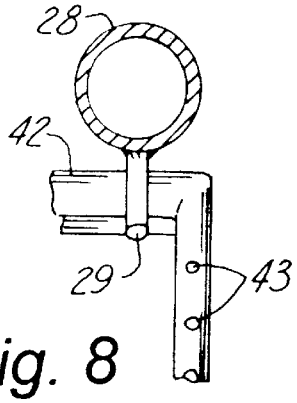
FIG. 8 is an isolated side view of the arrangement depicted in FIG. 5.

In addition, as shown in FIGS. 5 and 8, each of the clamp elements 29 on the underside of the articulated framework member 20 are adapted to selectively captively engage the top of each of the upper leg portions 42 of the support leg members 40, 40'.

As can best be appreciated by reference to FIGS. 1 through 4, the length of each support leg member 40, 40' is independently adjustable to maintain the adjacent framework segments 21, 22, 23, and 24 at various angular dispositions relative to one another in conjunction with the pivot adjustment arrangements 30.

As shown in FIG. 2, the pivot adjustment arrangements 30 determine the angular disposition between adjacent framework segments 21, 22, 23, and 24 while the adjustable support units 12 determine the height of the respective framework segments 21, 22, 23, 24 above the ground so that the lounge chair construction 10 can have an infinite number of angular adjustments to suit any possible need of the user.

Figure 3:
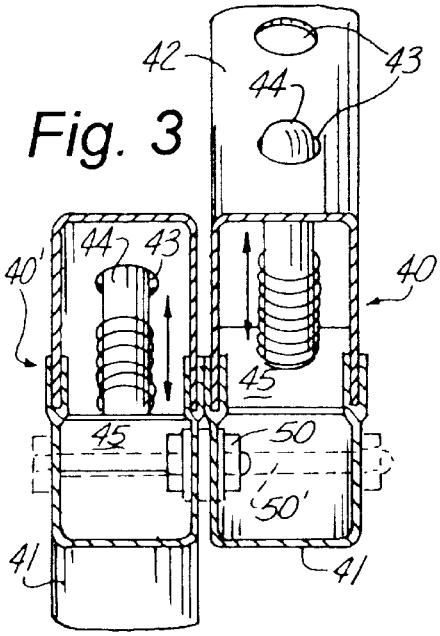
FIG. 3 is an enlarged detailed view of the detent mechanism that allows the length of the leg assemblies to be variably adjusted.

Turning now to FIGS. 3 and 4, it can be seen that in the preferred embodiment of the invention, the upper leg portion 42 of each of the leg members 40, 40' are provided with a plurality of apertures 43 which are dimensioned to receive a spring loaded detent 44 which rests upon a bearing plate 45 disposed within the interior of each of the lower leg portions 41 of each of the leg members 40, 40'.

In addition, in one version of the preferred embodiment depicted in FIG. 3, it can be seen that the support leg members 40, 40' are pivotally connected together by a fixed pivot rod 50 depicted in solid lines. In an alternate version of the preferred embodiment depicted in FIGS. 3 and 4, both the upper 42 and lower 41 portions of each of the support leg members 40, 40' are provided with a plurality of alignable transverse apertures 46 that are dimensioned to receive an elongated removable pivot rod 50' depicted in phantom.

In the alternate version of the preferred embodiment, the selective placement of the removable pivot rod 50' will allow an added degree of adjustability to the angularly adjustable lounge chair construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An angularly adjustable lounge chair construction comprising:

a lounge chair unit comprising an articulated tubular framework member including a plurality of tubular framework segments pivotally connected to one another;

a first adjustable support unit including a first pair of adjustable length support leg members pivotally connected to one another wherein each support leg member has a U-shaped lower leg portion and a U-shaped upper leg portion telescopically associated with one another;

means for angularly adjusting the plurality of segments of the articulated tubular framework member relative to one another;

means for independently adjusting the length of each of the pair of adjustable length support leg members; and means for selectively and releasably connecting the upper leg portions of each of the adjustable length support leg members to selected segments of the articulated tubular framework member.

2. The construction as in claim 1 wherein the plurality of segments of the articulated tubular framework member includes at least a lower torso segment and an upper torso segment.

3. The construction as in claim 2 wherein the plurality of segments of the articulated tubular framework member further includes a headrest segment.

4. The construction as in claim 2 wherein the plurality of segments of the articulated tubular framework member further includes a footrest segment.

5. The construction as in claim 2 wherein the plurality of segments of the articulated tubular framework member further includes a headrest segment and a footrest segment.

6. The construction as in claim 5 further comprising:

a second adjustable support unit including a second pair of adjustable length support leg members pivotally connected to one another wherein each support leg member has a U-shaped upper leg portion and a U-shaped lower leg portion telescopically associated with one another.

7. The construction as in claim 6 wherein the first pair of adjustable length support leg members are releasably connected to selected portions of the upper torso segment and the headrest segment of the articulated tubular framework member; and the second pair of adjustable length support leg members are releasably connected to selected portions of the lower torso segment and the footrest segment of the articulated tubular framework member.

8. The construction as in claim 7 wherein the articulated tubular framework member has an underside that is provided with a plurality of spaced clamp elements that are adapted to releasably engage the upper leg portions of each of the first pair of adjustable length support leg members.

9. The construction as in claim 8 wherein each of the segments of the articulated tubular framework member are provided with a plurality of strap elements which extend across the respective segments.

10. The construction as in claim 1 wherein the first pair of adjustable length support leg members are releasably connected to selected portions of the upper and lower torso segments of the articulated tubular framework member.

11. The construction as in claim 1 wherein the first pair of adjustable length support leg members are pivotally connected to one another via a fixed pivot rod.

12. The construction as in claim 1 wherein the first pair of adjustable length support leg members are pivotally connected to one another via a removable pivot rod which may be selectively positioned on each of the first pair of adjustable length support leg members.

* * * * *